US008443898B1

(12) United States Patent
McClinton et al.

(10) Patent No.: US 8,443,898 B1
(45) Date of Patent: May 21, 2013

(54) WELLHEAD SAFETY DEVICE

(75) Inventors: Tony D. McClinton, Odessa, TX (US); Buster Carl McClinton, Odessa, TX (US)

(73) Assignee: Tony D. McClinton, Odessa, TX (US)

( * ) Notice: Subject to any disclaimer, the term of this patent is extended or adjusted under 35 U.S.C. 154(b) by 0 days.

(21) Appl. No.: 13/428,254

(22) Filed: Mar. 23, 2012

(51) Int. Cl.
*E21B 17/10* (2006.01)

(52) U.S. Cl.
USPC ..... 166/363; 166/337; 166/344; 166/358; 166/368; 166/85.3; 285/55; 285/397

(58) Field of Classification Search ..... 166/363, 166/336–339, 341, 344, 351, 358, 360, 368, 166/85.1, 85.3, 75.13; 285/45, 55, 397, 417
See application file for complete search history.

(56) References Cited

U.S. PATENT DOCUMENTS

| | | | | |
|---|---|---|---|---|
| 6,003,602 | A * | 12/1999 | Wilkins | 166/339 |
| 6,220,349 | B1 | 4/2001 | Vargus et al. | |
| 6,302,212 | B1 * | 10/2001 | Nobileau | 166/368 |
| 6,491,108 | B1 | 12/2002 | Slup et al. | |
| 6,516,861 | B2 * | 2/2003 | Allen | 166/351 |
| 6,581,681 | B1 | 6/2003 | Zimmerman et al. | |
| 6,796,376 | B2 | 9/2004 | Frazier | |
| 6,966,381 | B2 * | 11/2005 | Stjernstrom et al. | 166/337 |
| 7,308,934 | B2 * | 12/2007 | Swagerty et al. | 166/177.5 |
| 7,467,663 | B2 * | 12/2008 | Reimert | 166/344 |
| 7,490,666 | B2 * | 2/2009 | Swagerty et al. | 166/177.5 |
| 7,578,351 | B2 * | 8/2009 | Dallas | 166/379 |
| 7,614,448 | B2 * | 11/2009 | Swagerty et al. | 166/177.5 |
| 7,644,757 | B2 * | 1/2010 | Artherholt | 166/113 |
| 7,647,973 | B2 * | 1/2010 | Minassian et al. | 166/338 |
| 7,743,824 | B2 * | 6/2010 | Lam et al. | 166/177.5 |
| 7,775,288 | B2 * | 8/2010 | Hickie | 166/379 |
| 7,806,175 | B2 * | 10/2010 | Hickie | 166/75.13 |
| 7,823,634 | B2 * | 11/2010 | Chan et al. | 166/86.3 |
| 7,857,062 | B2 * | 12/2010 | Dallas | 166/379 |
| 7,900,697 | B2 * | 3/2011 | Swagerty et al. | 166/177.5 |
| 8,136,604 | B2 * | 3/2012 | Jennings | 166/382 |
| 8,157,006 | B2 * | 4/2012 | Koleilat et al. | 166/177.5 |

* cited by examiner

*Primary Examiner* — Matthew Buck
(74) *Attorney, Agent, or Firm* — Buskop Law Group, PC; Wendy Buskop

(57) ABSTRACT

A wellhead safety device can include a tubular with outer surface portions having different diameters. A first seal groove can be disposed on a first outer diameter. A locking groove can be formed in a first outer surface portion, and can have sloping sides that taper to a center for receiving locking pins of a tubing head. A sloping guide can extend from a first end towards a central bore of the wellhead safety device. A second seal groove can be disposed on a second outer surface portion for containing a second seal. A guide shoulder can be formed on a second end, and can taper from the second outer surface portion to the central bore. A J-latch can be formed in the first end. A landing shoulder can stop the wellhead safety device from slipping into wellbores.

12 Claims, 5 Drawing Sheets

WELLHEAD SAFETY DEVICE

FIELD

The present embodiments generally relate to a wellhead safety device for isolating a portion of a wellhead during a fracturing operation.

BACKGROUND

In operations, a well can have a casing head supporting an outer casing string. A casing hanger can be positioned in the casing head to support an inner or production casing string. A tubing head can be positioned above the casing head. Oilfield wells typically have several strings or tubings.

During normal production operation, the tubing head can support a tubing hanger and production tubing. A production casing string can extend downward into a hydrocarbon bearing formation. U.S. Pat. No. 7,614,448 provides examples of these types of oilfield wells and other types of isolation apparatus. The teachings of U.S. Pat. No. 7,614,448 are incorporated herein by reference.

It is common to fracture a new well to increase the production capability of the new well. Generally, in this process, a sand bearing slurry is pumped down into the formation at very high pressures. Sand particles can become embedded in small cracks in the formation; thereby wedging the small cracks open and increasing the flow of produced fluid, such as oil, natural gas, or water.

Once fractionation of the new well is complete, the flow of the produced fluid can come back up through the production tubing to the wellhead, and the produced fluid can bring abrasive particulates that were pumped into the well back up the well. The abrasive particulates can wedge open equipment in the tubing head, which can cause a buildup of pressure and potentially explosions.

A need has long existed for a wellhead safety device that fits within a lower portion of a tubing head to provide redundant individual pressurized wellhead protection from particulates.

The tubing head can have valves that control the flow of the pressurized fluid coming from the fractionation. A need exists for a wellhead safety device that can isolate portions of the tubing head from the abrasive or corrosive fluids that come back up the well as a result of fractionation.

A need exists for a removable wellhead safety device that can be replaced without pulling the entire production string.

A need exists for a wellhead safety device that saves significant costs and time in the management of wells.

The present embodiments meet these needs.

BRIEF DESCRIPTION OF THE DRAWINGS

The detailed description will be better understood in conjunction with the accompanying drawings as follows.

Figure 1:
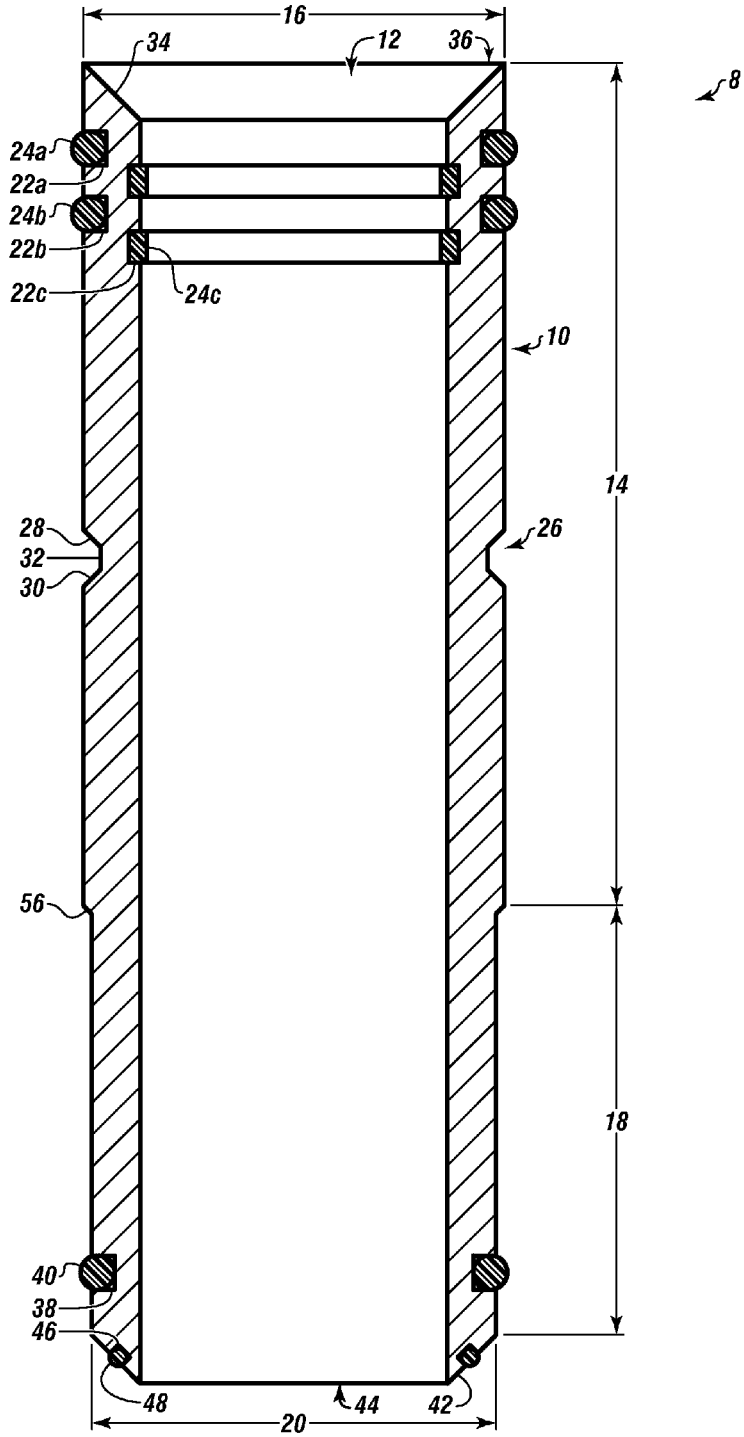
FIG. 1 depicts a cross sectional view of a wellhead safety device.

The present embodiments are detailed below with reference to the listed Figures.

DETAILED DESCRIPTION OF THE EMBODIMENTS

Before explaining the present apparatus in detail, it is to be understood that the apparatus is not limited to the particular embodiments and that it can be practiced or carried out in various ways.

The present embodiments relate to a wellhead safety device that can be formed from a tubular having a constant inner diameter bore and at least two different outer diameter portions.

The tubular, which can be a one-piece constant inner diameter bore tubular, can have a length ranging from about 3 feet to about 13 feet, a diameter ranging from about 4 inches to about 8 inches, and a wall thickness ranging from about 1 inch to about 3 inches. The diameter of the tubular can vary depending on the tubing head that is engaged therewith.

The tubular can be made of carbon steel, alloys of carbon steel, stainless steel, or combinations of these materials.

The wellhead safety device can have a unique outer profile that allows for both redundant sealing and safe landing of the wellhead safety device in a wellbore via a landing shoulder.

The landing shoulder can extend from a side of the tubular at an angle ranging from between about 30 degrees to about 45 degrees. As such, the landing shoulder can prevent the wellhead safety device from slipping into the wellbore while providing at least two sealing engagements with the tubing head.

In operation, an operator can prepare the wellhead safety device for operation by placing a seal in each seal groove thereof. The seals, which can be nitrile butyl O-rings, can then be greased, such as with lithium grease, a grease that is not harmful to the environment, or other grease.

The constant diameter inner bore of the tubing head, within which the wellhead safety device is inserted, can also be greased.

Next, a second outer surface portion of the tubular can be lowered into the tubing head until a landing shoulder contacts a similar shoulder within the inner diameter of the tubing head.

Lock screws in the tubing head can be tightened to engage a locking groove on the tubular.

A ring gasket can be positioned into a ring groove of the tubing head.

A gate valve can be lowered over a first end of the wellhead safety device until the gate valve rests on the ring gasket of the tubing head; thereby allowing the wellhead safety device to envelope equipment of the gate valve.

Bolts can be inserted through the gate valve and the tubing head, and nuts can be threaded to the bolts and torqued to a desired torque to energize the ring gasket; thereby creating a seal.

Once the wellhead safety device is installed, a test pump can be connected to a test port on the gate valve. A predetermined mount of test pressure can be applied to the test port for a predetermined length of time. The test pressure can range from about 5 psi to about 15,000 psi, and can be applied for a duration ranging from about 30 minutes to about 60 minutes.

A pressure gauge can be attached to the test pump to show a variable pressure if a leak is present. The pressure gauge can maintain pressure at a predetermined amount if no leak is present; thereby ensuring a positive seal.

After pressure testing, a relief valve on the test pump can be opened to relieve stored pressure from testing areas of the wellhead safety device.

A pressure detector can be inserted into each test ports to allow for 24 hours a day and 7 days a week constant pressure monitoring for early detection of compromised seals.

Turning now to the Figures, FIG. 1 depicts a cross sectional view of a wellhead safety device 8.

The wellhead safety device can include a tubular 10 can have a constant diameter central bore 12 along an entire length of the tubular 10.

An outside of the tubular 10 can have two different diameter surfaces, including a first outer surface portion 14 with a first outer diameter 16 and a second outer surface portion 18 with a second outer diameter 20.

The first outer diameter 16 can be larger than the second outer diameter 20. For example, the first outer diameter 16 can be from about 2.5 percent to about 5 percent larger than the second outer diameter 20.

In embodiments, the first outer surface portion 14 and the second outer surface portion 18 can be smooth surfaces or slightly roughened for increasing a friction of a seal between the wellhead safety device, the gate valve, and the tubing head.

In embodiments, the first outer surface portion 14 and the second outer surface portion 18 can be adapted to support a coating of grease.

A first seal groove 22*a* can be formed on and can encircle the first outer surface portion 14.

In one or more embodiments, additional first seal groove 22*b* and 22*c* can also be formed on and can encircle the first outer surface portion 14. The additional first seal grooves 22*b* and 22*c* can be disposed parallel to the first seal groove 22*a*.

A first seal 24*a* can be disposed in the first seal groove 22*a*. The first seal 24*a* can allow the wellhead safety device to seal against an inner diameter of the gate valve.

In embodiments, additional first seals 24*b* and 24*c* can be disposed in the additional first seal groove 22*b* and 22*c*.

A locking groove 26 can be formed in the first outer surface portion 14, and can encircle the constant diameter central bore 12. The locking groove 26 can be disposed parallel with the first seal groove 22*a* and the additional first seal grooves 22*b* and 22*c*.

The locking groove 26 can have a unique shape formed be a first sloping side 28 and a second sloping side 30. The first sloping side 28 and the second sloping side 30 can taper towards a center 32 of the locking groove 26. The slopes of the first sloping side 28 and the second sloping side 30 can be at angles of 40 degrees or greater.

The unique shape of the locking groove 26 can be configured to receive locking pins of the tubing head; thereby enabling the wellhead safety device to be locked into the tubing head via the locking groove 26.

In one or more embodiments, the locking groove 26 can be colored with a pigment to allow for easy visual recognition of a size of the tubular 10 in the field.

A sloping guide 34 can be formed as an inwardly sloping shoulder extending from a first end 36 of the tubular 10 towards the constant diameter central bore 12. The slope of the sloping guide 34 can range from about 40 degrees to about 50 degrees. The length of the sloping guide 34 can range from about 1 inch to about 3 inches.

The second outer surface portion 18 can be integral with the first outer surface portion 14 to form the tubular 10.

A second seal groove 38 can be formed in the second outer surface portion 18. The second seal groove 38 can be formed around a perimeter of the constant diameter central bore 12, and can be disposed parallel to the first seal groove 22*a*, the additional first seal groove 22*b*, and the locking groove 26.

A second seal 40 can be disposed in the second seal groove 38 for sealing against a surface within the tubing head.

In one or more embodiments, the first seal 22*a*, the additional first seals 22*b* and 22*c*, and the second seal 40 can be compressible nitrile rubber seals.

The tubular 10 can have a second end 44 opposite the first end 36.

A guide shoulder 42 can be formed on the second end 44 and can extend therefrom.

The guide shoulder 42 can taper towards the constant diameter central bore 12. The guide shoulder 42 can taper at an angle of about 45 degrees, and can have a length ranging from about 1 inch to about 5 inches.

A landing shoulder 56 can be formed on the perimeter of the tubular 10, and can separate the first outer surface portion 14 from the second outer surface portion 18.

The landing shoulder 56 can be disposed between the locking groove 26 and the second seal groove 38, and can prevent the wellhead safety device from slipping into wellbores.

A trash groove 46 can be formed on the second outer surface portion 18 at the second end 44 for holding a non-pressurized seal 48. The trash groove 46 can prevent trash, such as sand particulate, from moving up the outside of the tubular 10.

Figure 2:
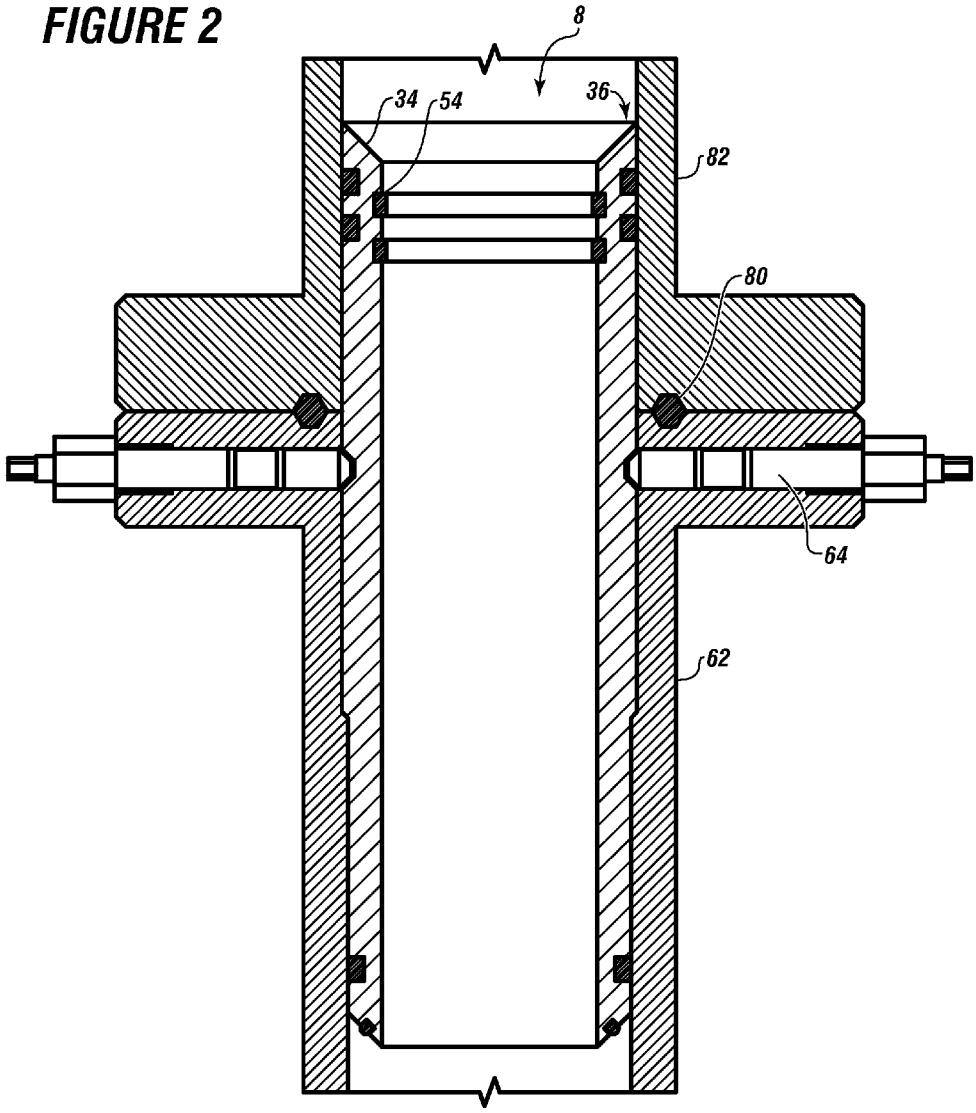
FIG. 2 depicts a perspective view of the wellhead safety device disposed within the tubing head.

FIG. 2 depicts a perspective view of the wellhead safety device 8 disposed within the tubing head 62.

The first end 36 can be configured to engage a running tool. For example, the first end can have a J-latch, a first cut, and a second cut.

The sloping shoulder 34 can form a lip. An inner groove 54 can be formed under the lip.

The wellhead safety device 8 can be installed in the tubing head 62, and locking pins 64 can engage secure the wellhead safety device 8 within the tubing head 62.

A gasket 80 can be disposed between the tubing head 62 and a gate valve 82. The gate valve 82 can be secured to the tubing head 62.

In one or more embodiments a slick coating, such as TEFLON®, can be adhered on the outer diameter surfaces of the wellhead safety device 8 to enable for fast engagement and release with the tubing head 62 and the gate valve 82. The slick coating can be from about 1/64 of an inch to about 1/32 of an inch thick, and can be deposited by dipping, spraying, or other conventional coating processes.

Figure 3:
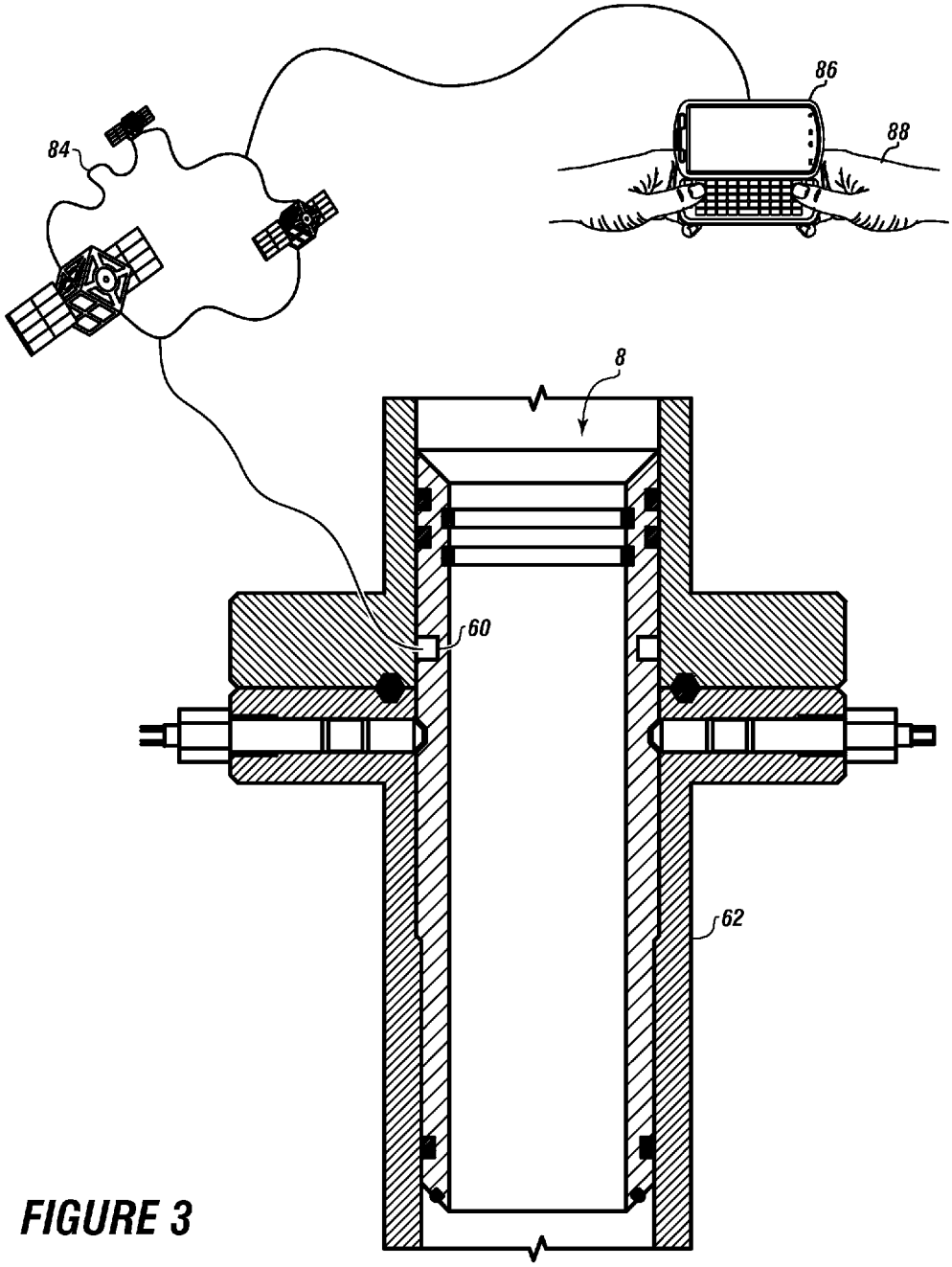
FIG. 3 depicts a schematic of a communication network that can be used with wellhead safety device disposed within a tubing head.

FIG. 3 depicts a schematic of a communication network that can be used with wellhead safety device 8 disposed within a tubing head 62.

The wellhead safety device 8 can have a pressure detector 60 disposed thereon. The pressure detector 60 can acquire data on pressure. For example, the pressure detector 60 can monitor for pressure changes.

The pressure detector 60 can be in communication with a client device 86 through a network 84. One or more users 88 can view the client device 86.

Figure 4:
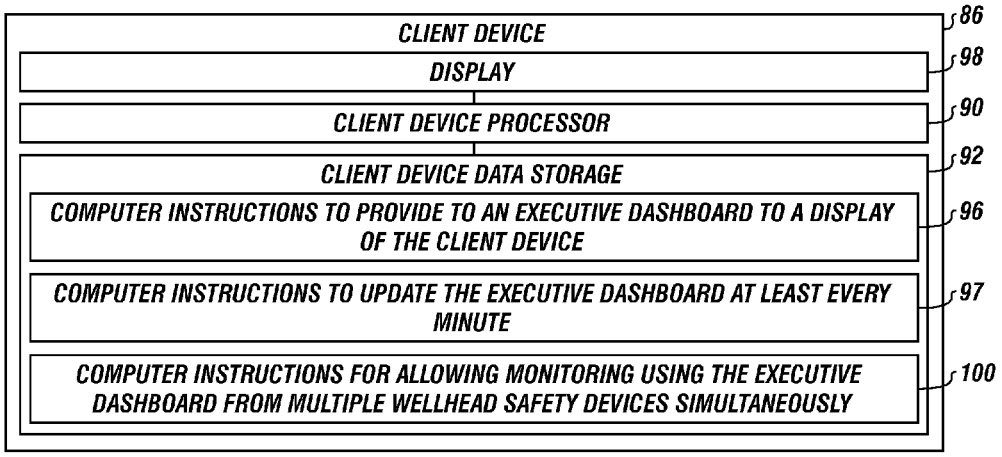
FIG. 4 depicts a detail of the client device.

FIG. 4 depicts a detail of the client device 86.

The client device 86 can include a client device processor 90 and a client device data storage 92.

In one or more embodiments, the client device 86 can be a laptop, a cell phone, a tablet computer, a satellite phone, another type of processor, a personal digital assistant, a web server, or combinations thereof.

The client device data storage 92 can have computer instructions to provide an executive dashboard to a display of the client device 96. For example, the client device 86 can present the executive dashboard on a display 98 of the client device 86.

The executive dashboard can allow the user to monitor pressure changes between the gate valve and tubing head 24 hours a day, 7 days a week. The user can be a computer.

The client device data storage 92 can have computer instructions to update the executive dashboard at least every minute 97.

The client device data storage 92 can have computer instructions for allowing monitoring using the executive dashboard from multiple wellhead safety devices simultaneously 100.

Figure 5:
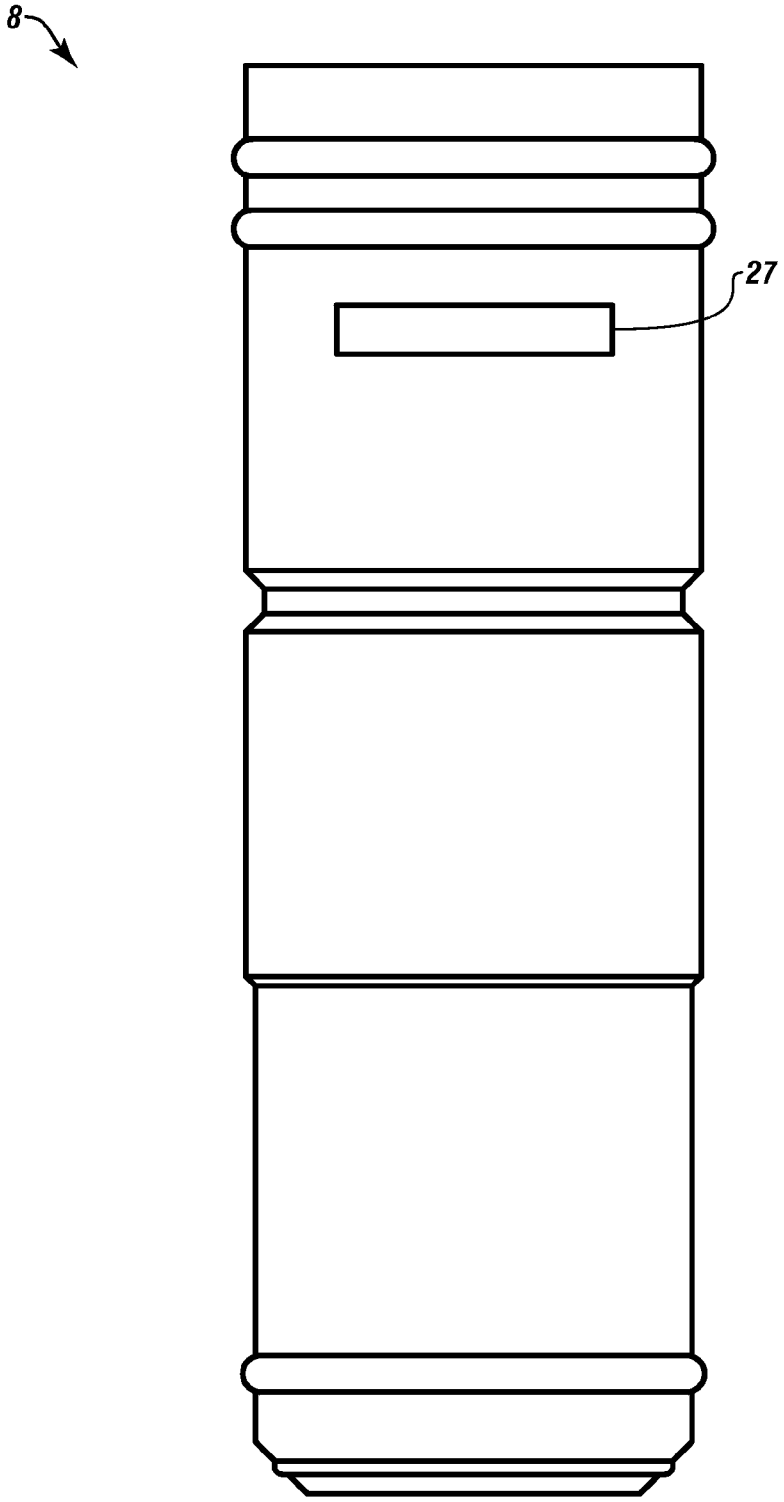
FIG. 5 depicts an isometric view of the wellhead safety device.

FIG. 5 depicts an isometric view of the wellhead safety device 8.

The wellhead safety device 8 can have a message area 27 formed on an outer surface thereof. The message area 27 can be marked to indicate the type of tubing head that the wellhead safety device 8 can engage with.

While these embodiments have been described with emphasis on the embodiments, it should be understood that within the scope of the appended claims, the embodiments might be practiced other than as specifically described herein.

What is claimed is:

1. A wellhead safety device for simultaneously fitting within a lower portion of a tubing head, wherein the tubing head has locking pins, and wherein the wellhead safety device extends into a gate valve, providing redundant individual pressurized wellhead protection from particulates, wherein the wellhead safety device comprises:

a. a one-piece, constant inner diameter bore tubular having a constant diameter central bore, wherein the one-piece constant inner diameter bore tubular comprises a first outer surface portion with a first outer diameter and a second outer surface portion with a second outer diameter, and wherein the first outer diameter is larger than the second outer diameter;

b. a first seal groove disposed on the first outer diameter;

c. a first seal disposed in the first seal groove for sealing against an inner diameter of the gate valve;

d. a locking groove formed in the first outer surface portion, wherein the locking groove comprises a first sloping side and a second sloping side, and wherein the first sloping side and the second sloping side both taper towards a center of the locking groove for receiving the locking pins of the tubing head;

e. a sloping guide extending from a first end of the one-piece constant inner diameter bore tubular towards the constant diameter central bore;

f. a second seal groove disposed on the second outer surface portion;

g. a second seal disposed in the second seal groove for sealing against an inner diameter of the tubing head;

h. a guide shoulder formed on a second end of the one-piece constant inner diameter bore tubular, wherein the guide shoulder tapers from the second outer surface portion to the constant diameter central bore, wherein a trash groove is formed on the guide shoulder, and wherein a non-pressurized seal is disposed in the trash groove;

i. a J-latch formed in the first end, wherein the J-latch comprises two cuts and an inner groove for receiving a running tool that connects the one-piece constant inner diameter bore tubular in the tubing head;

j. a landing shoulder formed on an outside of the one-piece constant inner diameter bore tubular between the locking groove and the second seal groove for stopping the wellhead safety device from slipping into a wellbore;

k. a pressure detector disposed adjacent the first outer diameter and connected to the tubing head for determining a pressure leak between the first seal groove and the second seal groove; and l. a client device disposed remote to and in communication with the pressure detector, wherein the client device comprises a client device processor, a client device data storage, and computer instructions in the client device data storage for providing an executive dashboard on a status of pressures in the constant diameter central bore.

2. The wellhead safety device of claim 1, further comprising computer instructions in the client device data storage to update the executive dashboard at least every minute.

3. The wellhead safety device of claim 1, wherein the client device is a laptop, a cell phone, a tablet, a satellite phone, another type of processor, a personal digital assistant, a web server, or combinations thereof.

4. The wellhead safety device of claim 1, wherein the client device is in communication with the pressure detector via a network, and wherein the network is the Internet, a local area network, a wide area network, a satellite network, a cellular network, or combinations thereof.

5. The wellhead safety device of claim 1, wherein the landing shoulder extends from the outside of the one-piece constant inner diameter bore tubular at a 45 degree angle.

6. The wellhead safety device of claim 1, wherein the one-piece constant inner diameter bore tubular has a length ranging from 3 feet to 13 feet, a diameter ranging from 4 inches to 8 inches, and a wall thickness ranging from 1 inch to 3 inches.

7. The wellhead safety device of claim 1, wherein the one-piece constant inner diameter bore tubular comprises carbon steel, alloys of carbon steel, stainless steel, or combinations thereof.

8. The wellhead safety device of claim 1, wherein the first seal and the second seal comprise a compressible nitrile rubber.

9. The wellhead safety device of claim 1, further comprising two additional first seal grooves adjacent the first seal groove, wherein each additional seal groove has seals contained therein for providing additional sealing.

10. The wellhead safety device of claim 1, further comprising a coating disposed on the first outer surface portion and the second outer surface portion, enabling for fast engagement and release thereof.

11. The wellhead safety device of claim 1, wherein the locking groove is colored with a pigment to allow for easy visual recognition of a size thereof in the field.

12. The wellhead safety device of claim 1, further comprising a message area on the wellhead safety device, allowing the wellhead safety device to be marked to indicate a type of the tubing head that the wellhead safety device is configured to engage.

* * * * *